US012398335B2

(12) United States Patent
Raman et al.

(10) Patent No.: US 12,398,335 B2
(45) Date of Patent: Aug. 26, 2025

(54) $SO_X$ EMISSION CONTROL STRATEGY FOR MARINE ENGINE APPLICATION THROUGH FORMULATION OF ISO 8217 COMPLIANT LOW-SULFUR DISTILLATE BLEND (LSDB) FUELS

(71) Applicant: SAUDI ARABIAN OIL COMPANY, Dhahran (SA)

(72) Inventors: Vallinayagam Raman, Dhahran (SA); Junseok Chang, Dhahran (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 125 days.

(21) Appl. No.: 18/360,619

(22) Filed: Jul. 27, 2023

(65) Prior Publication Data

US 2025/0034468 A1 Jan. 30, 2025

(51) Int. Cl.
*C10L 1/04* (2006.01)

(52) U.S. Cl.
CPC ..... *C10L 1/04* (2013.01); *C10L 2200/0263* (2013.01); *C10L 2200/0438* (2013.01); *C10L 2230/22* (2013.01); *C10L 2270/026* (2013.01); *C10L 2290/24* (2013.01); *C10L 2290/60* (2013.01)

(58) Field of Classification Search
CPC ..... C10L 1/04; C10L 2200/0263; C10L 2200/0438; C10L 2230/22; C10L 2270/026; C10L 2290/24; C10L 2290/60
See application file for complete search history.

(56) References Cited

U.S. PATENT DOCUMENTS

| | | | | |
|---|---|---|---|---|
| 9,109,176 | B2 | 8/2015 | Stern et al. | |
| 9,920,270 | B2 | 3/2018 | Robinson et al. | |
| 10,443,006 | B1 * | 10/2019 | Fruchey | C10L 1/08 |
| 10,800,982 | B2 | 10/2020 | Peer et al. | |
| 2013/0014431 | A1 | 1/2013 | Jin et al. | |
| 2013/0019522 | A1 | 1/2013 | Eaton et al. | |
| 2015/0353851 | A1 | 12/2015 | Buchanan | |
| 2019/0093026 | A1 | 3/2019 | Wohaibi et al. | |

(Continued)

OTHER PUBLICATIONS

Breneol, Armelle, "Marine Fuel Stability and Compatibility—Issues, Tests and Management"; <https://www.exxonmobil.com/en/marine/~/media/files/global/us/marine/news-and-resources/marine-fuel-stability-and-compatibility>; Accessed Jul. 27, 2023 (4 pages).

(Continued)

*Primary Examiner* — Ellen M McAvoy
*Assistant Examiner* — Chantel Graham
(74) *Attorney, Agent, or Firm* — Osha Bergman Watanabe & Burton LLP

(57) ABSTRACT

A method for blending fuel streams to produce a low-sulfur distillate blend includes formulating a blend composition using a model, calculating a projected stability of the determined composition using a predictive stability model, and forming a low-sulfur distillate blend based on the determined composition by mixing determined input streams at the blending ratio. A low-sulfur distillate blend (LSDB) for marine engines includes a blend of residual and distillate fuel streams that satisfies the IMO global sulfur cap of 0.5 wt % sulfur and is stable without any separation of blend components.

20 Claims, 5 Drawing Sheets

(56) References Cited

U.S. PATENT DOCUMENTS

| | | | | |
|---|---|---|---|---|
| 2021/0024842 | A1 | 1/2021 | Fruchey et al. | |
| 2021/0363444 | A1* | 11/2021 | Kar | C10L 1/04 |

OTHER PUBLICATIONS

MAN Energy Solutions, "0.50 % S fuel operation 2020"; Aug. 2019; <https://shipandbunker.com/download/Paper%200.50-s-fuel-operation-2020%20MAN%20ES%202-S.pdf>; Accessed Jul. 27, 2023 (56 pages).

* cited by examiner

$SO_X$ EMISSION CONTROL STRATEGY FOR MARINE ENGINE APPLICATION THROUGH FORMULATION OF ISO 8217 COMPLIANT LOW-SULFUR DISTILLATE BLEND (LSDB) FUELS

BACKGROUND

The International Maritime Organization (IMO) has introduced rules aiming at reducing sulfur oxide ($SO_X$), nitrogen oxide ($NO_X$), carbon dioxide ($CO_2$) and other greenhouse gas emissions as part of Annex VI of the International Convention for the Prevention of Pollution from Ships, often abbreviated as the MARPOL Convention. IMO has set ambitious targets to reduce at least 50% total greenhouse gas (GHG) emissions from shipping by 2050, while at the same time reducing the average carbon intensity ($CO_2$ per ton-mile) by at least 40% by 2030 and 70% before mid-century. The IMO goals are summarized in FIG. 1. Energy Efficiency Design Index (EEDI) measures the $CO_2$ emitted (g/ton-mile) based on ship design and engine performance data. The EEDI level is tightened incrementally every five years with an initial $CO_2$ reduction level of 10% for the first phase (2015-2020), 20% for the second phase (2020-2025) and a 30% reduction mandated from 2025 to 2030. Thus, the maritime industry is currently posed with a long-term challenge to meet the GHG emission targets. Previously, heavy fuel oil (HFO) with high sulfur content (3.5%) has been used as fuel in ships. With HFO fuel, the ships tend to emit increased $SO_X$ emissions after combustion in engines, which has major health and environmental consequences. To combat this, IMO limits the sulfur in fuel to 0.5% from 3.5% in the global region as of 2020. In emission control arcas (ECAs), as shown in FIG. 1, the sulfur in the fuel should be further reduced to 0.1%. The new limit is made compulsory, and so it is unfortunately not possible to use the less expensive low grade HFO fuel in ships.

One option to reduce $SO_X$ emissions with HFO is to utilize scrubbers. However, the use of scrubbers is not advantageous due to regulatory restrictions related to the water pollution caused by the disposal of treated water from scrubbers using open loop systems. Many nations have banned the use of open loop scrubbers and thus the adoption of $SO_X$ scrubbers is limited despite being a cost-effective solution. Moreover, vessels using scrubbers are not compatible with certain fuels and this would complicate the transition towards low carbon fuels. Taking the long view in shipping is important, as vessels are long term assets and ships ordered today will compete with vessels coming into the market 10 to 15 years from now, meaning current plans must include future fuel standards. Therefore, in order to comply with IMO's 2020 global sulfur limit, ships must switch from HFO to low-sulfur fuel candidates. For $SO_x$, the basis for scoring is the average $SO_x$ content in fuels for main and auxiliary engines used during a running year. Scores can be obtained if the $SO_x$ content in fuel or in the treated exhaust gases is lower than the global (IMO) standards for both main and auxiliary engines. Extra points are awarded to ships for using low-sulfur fuel in main engines, auxiliary engines, and/or boilers when navigating in port areas outside ECAs.

In ECAs, marine gas oil (MGO) is preferred as one of the clean fuels with sulfur <0.1 wt %. MGO used in ships is a blend component of light cycle oil (LCO) produced from vacuum residue, and the market price of MGO is currently as expensive as diesel fuel. MGO or diesel type fuels cannot be used in global regions because they are cost prohibitive compared to HFO. The refineries are now trying to produce IMO compliant low-sulfur fuel oil that is cost effective enough to be used in global areas. Very low-sulfur fuel oil (VLSFO—0.5%) can be produced by a process improvement in the refinery. The atmospheric residue produced from the distillation process undergoes a deep hydro-desulfurization process to achieve the 0.5% sulfur limit. The process is quite intensive and requires increased pressure and temperature conditions, leading to a high cost to produce VLSFO. While complying with the sulfur limits, the VLSFO is as expensive as MGO. Use of either MGO or VLFSO may not be an economically viable solution in global areas. Because of this there is a need for refiners to develop more promising ways of producing economically viable, low-sulfur compliant fuel oil.

In addition to the economic infeasibility of using VLSFO, there are technical challenges associated with the use of VLSFO. Marine engine manufacturers have reported several durability issues when using new compliant VLSFO fuel. The notable issues are fuel stability and compatibility caused by the different fuel properties of VLSFO, such as lower viscosity and cold flow properties. The lower viscosity of the VLSFO also causes issues with fuel injection systems such as clogging, wear, and related fuel compatibility problems.

SUMMARY

Embodiments herein address both the technical and economic challenges with low-sulfur fuel oil for marine engine applications, providing for marine engine manufacturers to make a fuel with desirable properties similar to VLSFO that is also compatible with marine engines.

In one aspect, embodiments disclosed herein relate to a method for blending fuel streams to produce a low-sulfur distillate blend which includes formulating a blend composition using a model, calculating a projected stability of the determined composition using a predictive stability model, and forming a low-sulfur distillate blend based on the determined composition by mixing determined input streams at the blending ratio.

In another aspect, embodiments disclosed herein relate to a low-sulfur distillate blend (LSDB) for marine engines which includes a blend of residual and distillate fuel streams that satisfies the IMO global sulfur cap of 0.5 wt % sulfur and is stable without any separation of blend components.

This summary is provided to introduce a selection of concepts that are further described below in the detailed description. This summary is not intended to identify key or essential features of the claimed subject matter, nor is it intended to be used as an aid in limiting the scope of the claimed subject matter. Other aspects and advantages of the claimed subject matter will be apparent from the following description and the appended claims.

DETAILED DESCRIPTION

IMO Specifications for Marine Fuels

Figure 1:
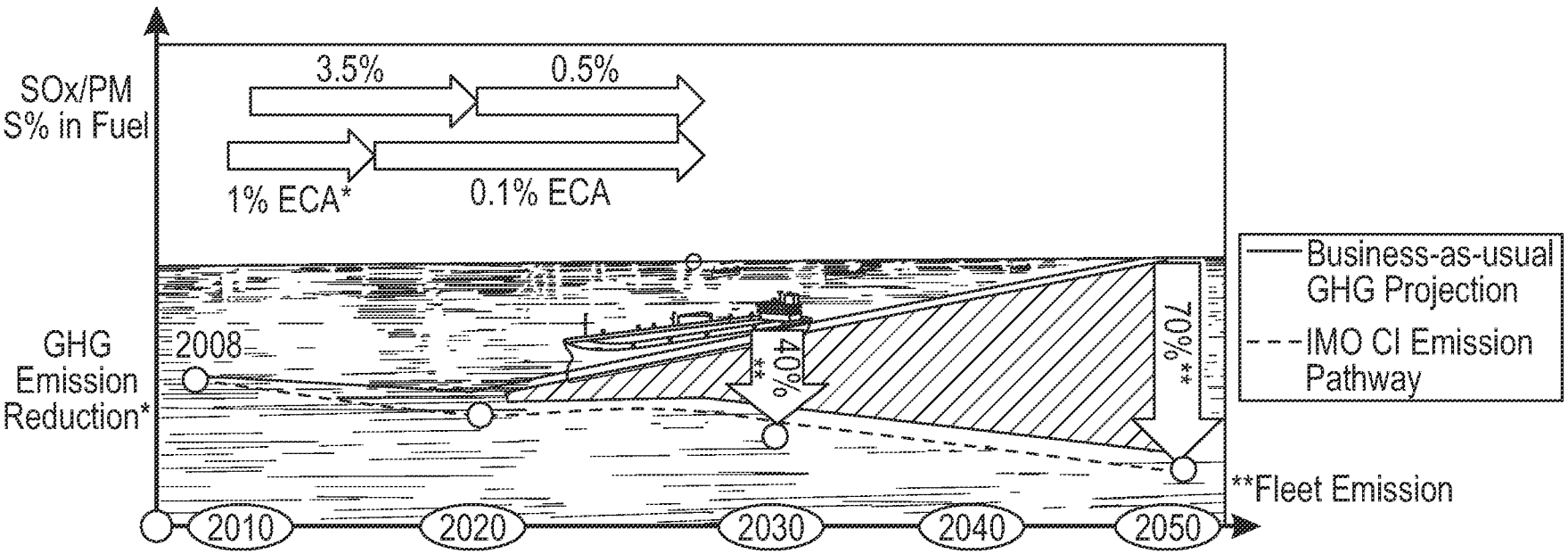
FIG. 1 is a diagram detailing the IMO requirements in marine fuels over the next several decades.

The United Nation's chartered International Maritime Organization (IMO) regulates marine transportation globally. FIG. 1 details the IMO requirements in marine fuels over the next several decades. In the ISO 8217 standard "Petroleum Products—Fuel (class F) the specifications and requirements of marine fuels are specified. The ISO 8217 standard classifies marine fuels into two categories as either residual fuels or distillate fuels based on the fuel components present. The specifications of residual and distillate marine fuels are listed in Table 1 and Table 2. The residual fuels are classified as different grades including RMA, RMB, RMD, RME, RMG and RMK. Though aluminum (Al) and silicon (Si) are not compatible with engines, these elements are present because some components of these fuels are made through a fluid catalytic cracking process, which uses Al and Si catalysts. The flash point of the fuels used in ships should be at least 60° C. Note that RMA has lower viscosity similar to distillate fuels, but the sulfur content is higher. The most used marine fuels are of RMG grade, also known as intermediate fuel oil (IFO). IFO has a sulfur content of 3.5% and had been used in the market until 2019. With the new sulfur regulations in place, the HFO with 3.5% sulfur content is either not used or the use of scrubbers is required to comply with the sulfur regulations. However, scrubbers are not a good option for the near future because of their regulatory concerns and compatibility issues with some low carbon fuels.

Distillate fuels have gained importance with the IMO's plan to lower the sulfur content requirement outside emission control areas to 0.5%. Given that the cost of MGO and VLSFO are comparable, ship industries might consider using distillate sources in abundance. The distillates are produced from light gas oil cuts produced through atmospheric distillation. ISO 8217 classifies distillates into four categories as DMX, DMA, DMB and DMZ. The viscosities of these distillate fuels range from 1.4 cSt (centistokes) to 11 cSt. While light distillates are similar to diesel type fuels, their densities are higher with cetane numbers ranging from 35 to 45. Unlike residuals, distillates do not require preheating before using in engines. DMX is a pure distillate fuel and is used in smaller engines such as boats and emergency units. DMA and DMZ are pure distillates, but DMB contains some fraction of residuals. DMZ fuel contains higher aromatic content, and its viscosity is higher compared to other distillates. While DMA fuel is bright and clear in appearance, DMB fuel is not bright and clear in appearance due to the presence of residual fuel fractions.

TABLE 1

Marine Residual Fuel Specifications from ISO 8217
Marine residual fuels

| | | Grades | | | | | |
|---|---|---|---|---|---|---|---|
| Test methods | Properties | RMA | RMB | RMD | RME | RMG | RMK |
| ISO 3104 | Viscosity at 50° C. (cSt) | 10 | 30 | 80 | 180 | 180-380 | 500-700 |
| ISO 3675 | Density at 15° C. (kg/m$^3$) | 920 | 960 | 975 | 991 | 991 | 1010 |
| ISO 10370 | Micro carbon residue (% m/m) | 2.5 | 10 | 14 | 15 | 18 | 20 |
| IP 470 | Aluminum + silicon (mg/kg) | 25 | 0 | 0 | 50 | 60 | 60 |
| IP 470 | Sodium (mg/kg) | 50 | 100 | 100 | 50 | 100 | 100 |
| ISO 6245 | Ash (% m/m) | 0.04 | | 0.07 | | 0.1 | 0.15 |
| IP 470 | Vanadium (mg/kg) | 50 | | 150 | | 350 | 450 |
| | CCAI | 850 | | 860 | | 870 | 870 |
| ISO 3733 | Water (% v/v) | | | 0.3 | | 0.5 | 0.5 |
| ISO 2719 | Flash point (° C.) | | | 60 | | | |
| ISO 3016 | Pour point (° C.) | | | 0 | | 30 | 30 |
| ISO 8754 | Sulfur (% m/m) | To comply with statutory requirements | | | | | |
| ISO 10307 | Total sediment (% m/m) | | | 0.1 | | | |
| ASTM D664 | Acid number (mg KOH/g) | | | 2.5 | | | |
| IP 570 | Hydrogen sulfide (mg/kg) | | | 2 | | | |

TABLE 2

Marine Distillate Fuel Specifications from ISO 8217
Marine distillate fuels

| Test methods | Grades Properties | DMX | DMA | DMB | DMZ |
|---|---|---|---|---|---|
| ISO 3104 | Viscosity at 40° C. (cSt) | 1.4-5.5 | 2-6 | 3-6 | 2-11 |
| ISO 3675 | Density at 15° C. (kg/m$^3$) | — | 890 | 890 | 900 |
| ISO 10370 | Micro carbon residue (% m/m) | — | — | — | 0.3 |
| ISO 6245 | Ash (% m/m) | | 0.01 | | |
| IP 470 | Vanadium (mg/kg) | | | | |
| ISO 4264 | Cetane index | 45 | 40 | 40 | 35 |
| ISO 3733 | Water (% v/v) | | | | 0.3 |
| ISO 2719 | Flash point (° C.) | 43 | | 60 | |
| ISO 3016 | Pour point (° C.) | — | 0 | 0 | 6 |
| ISO 3015 | Cloud point (° C.) | 16 | — | — | — |
| ISO 8754 | Sulfur (% m/m) | 1 | 1.5 | 1.5 | 2 |
| ISO 10307 | Total sediment (% m/m) | | | | 0.1 |
| ASTM D664 | Acid number (mg KOH/g) | | 0.5 | | |
| ISO 12205 | Oxidation stability (g/m$^3$) | | 25 | | |
| IP 570 | Hydrogen sulfide (mg/kg) | | 2 | | |

Residual and Distillate Fuel Blending for Low-Sulfur Distillate Blends for Use in Marine Engine Applications In a refinery, crude oil undergoes an atmospheric distillation process and different fractions are obtained. While gasoline, naphtha, kerosene, and other fractions distill as lighter fractions in the distillation column, gas oil is also produced as one of the lighter cuts. Gas oil is subjected to a hydro-treatment process to produce diesel fuel. The products from the atmospheric distillation unit are classified as distillates (specifications in table 2). The residue that comes out of the atmospheric distillation column, known as atmospheric residue (AR), undergoes a vacuum distillation process to generate vacuum gas oil (VGO). The primary use of VGO is to feed cracking units such as a fluid catalyst cracking (FCC) unit or hydrocracker. In the cracking unit, VGO is upgraded into more useful products such as light cycle oil (LCO), heavy cycle oil (HCO), gasoline, or diesel. Note that the VGO must be de-sulfurized either directly or indirectly before going through a cracking unit. The vacuum residue is a heavy component that is collected at the bottom of the vacuum distillation unit. The products from the vacuum distillation unit are classified as residuals (specifications in Table 1).

Figure 2:
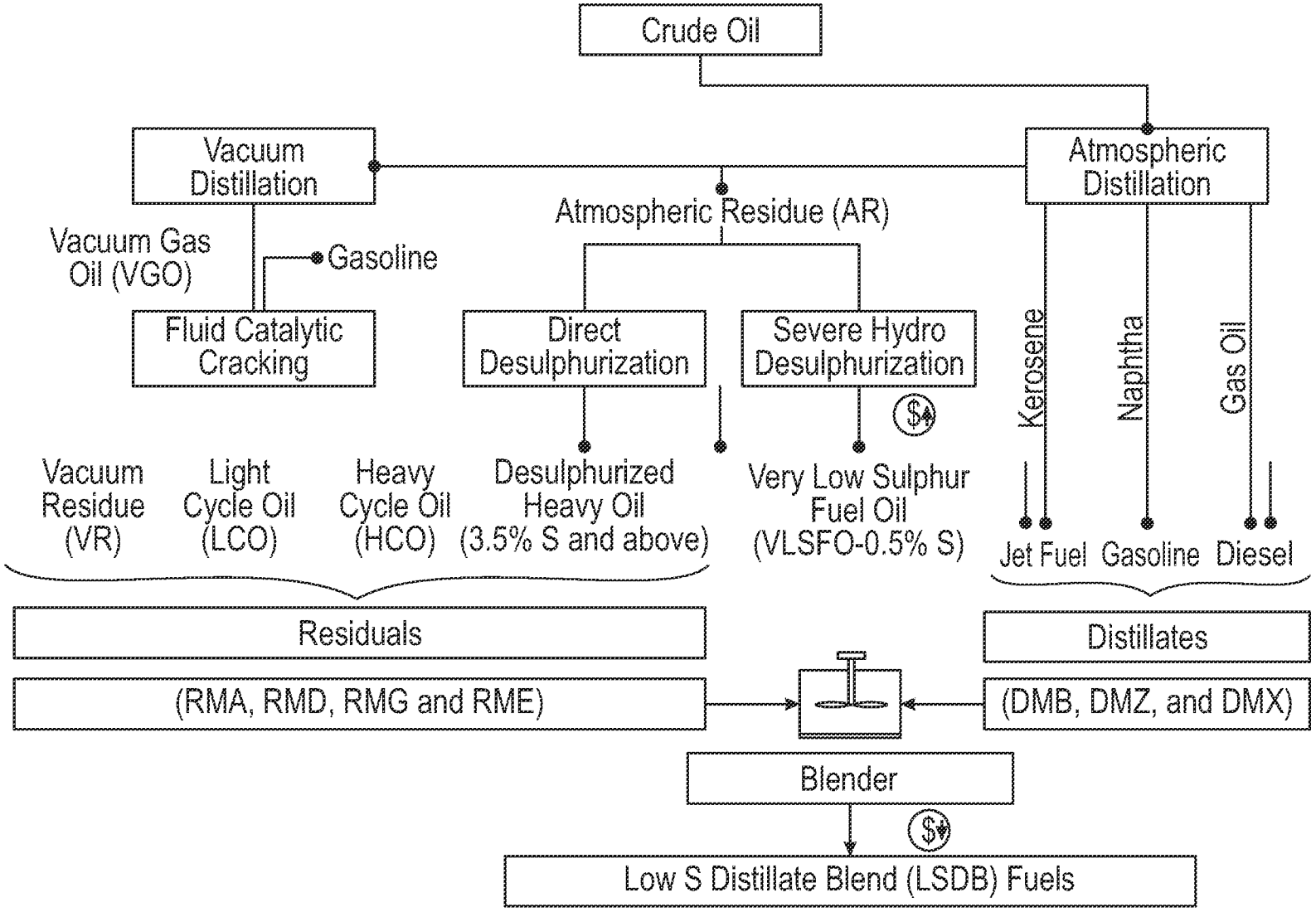
FIG. 2 is a diagram depicting the relationship between fuel streams utilized in formulating low sulfur distillate blends (LSDBs) in accordance with one or more embodiments of the present disclosure.

Through an intensive hydro-treatment process, VLSFO can be produced from AR. The VLSFO fuel would have lower viscosity and density compared to conventional HFO, but it is still categorized as a residual fuel. In addition to being cost prohibitive, the compliant VLSFO possesses compatibility issues. In one or more embodiments, embodiments herein provide low-sulfur fuels classified under a distillate fuel category known as low-sulfur distillate blends (LSDBs). The LSDBs are formulated by blending suitable residual fuels with low sulfur distillate fuels. To formulate economically viable low sulfur fuels, streams that are cheaper and easily available are prioritized. Given that blending is not as expensive as deep hydro-treatment or de-sulfurization techniques, the resultant formulated blend fuels should be cost effective. With a predominantly higher concentration of distillates, blend stability is also ensured. In broader terms, embodiments of LSDBs provided herein are compliant with IMO specified fuel properties under a distillate category with sulfur of 0.5% or less. Furthermore, the proposed blends would be technically viable due to blend stability and engine compatibility and economically viable due to low production costs. FIG. 2 depicts the relationship between fuel streams utilized in formulating LSDBs according to embodiments herein.

In one aspect, embodiments disclosed herein relate to low-sulfur fuel blends for use in marine engine applications, which include 60 to 95 wt % distillate fuels, and 5 to 40 wt % residual fuels. The distillate fuels in the blends may include one or more of gas oil, kerosene, jet fuel, diesel fuel, full range naphtha, light naphtha, heavy naphtha, and gasoline, for example. Other intermediate or fully developed distillate streams from the refinery may also be used. Residual fuels in the blends may include one or more of light arab crude oils, atmospheric residue, vacuum residue, deasphalted oil, vacuum gas oil, light cycle oil, heavy cycle oil, and heavy gas oil, for example. Other intermediate or fully developed residual stream from the refinery may also be used. With such compositions, these low-sulfur fuel blends can be categorized as low-sulfur distillate blends (LSDBs).

Blending Methodology

Figure 3:
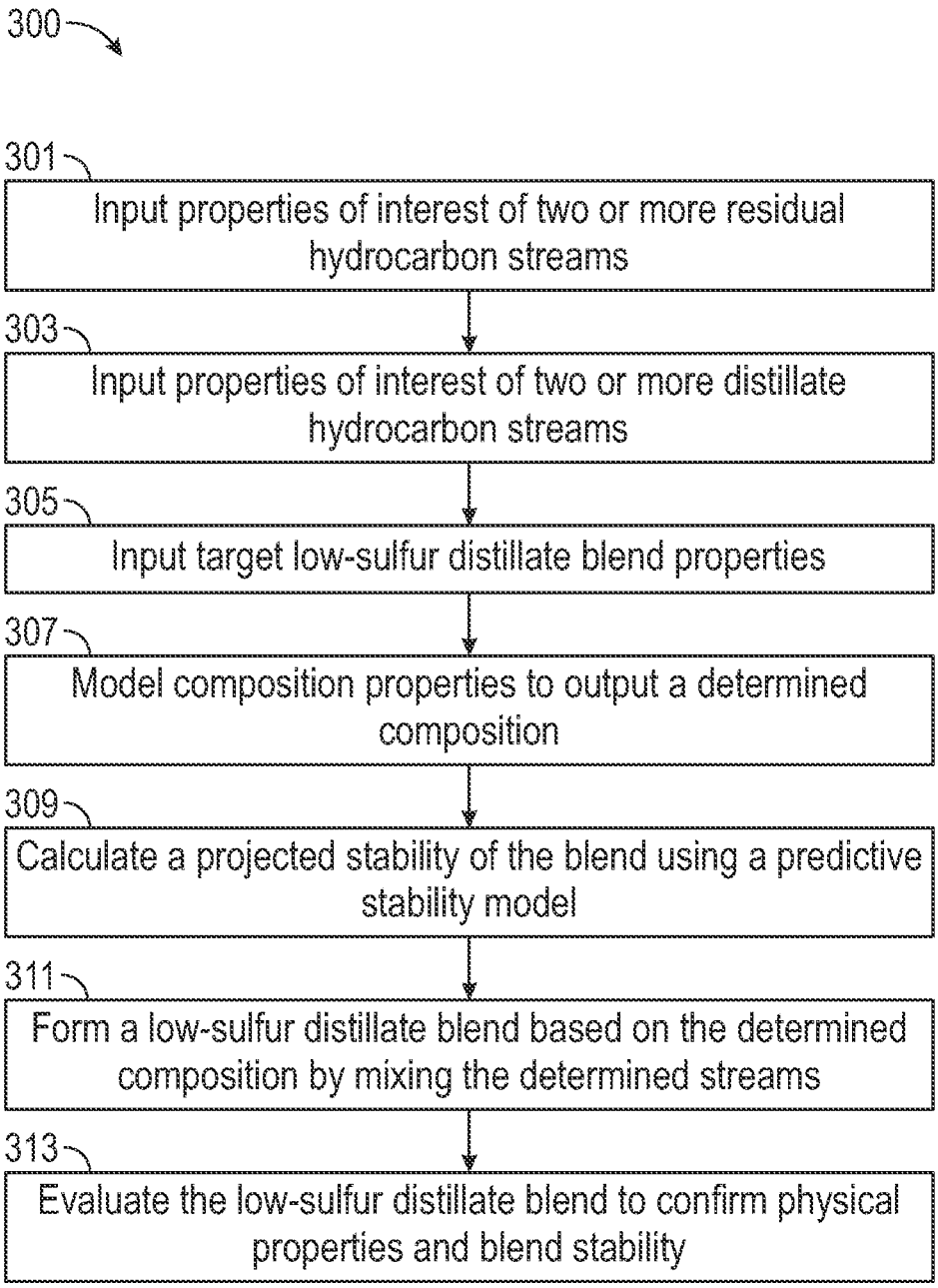
FIG. 3 is a block-flow diagram of a method in accordance with one or more embodiments of the present disclosure.

In another aspect, embodiments herein relate to a method for blending LSDBs, depicted in FIG. 3. In the future, the demand for diesel is projected to increase leading to other lighter fractions, like low carbon gasoline, being produced in abundance. In one or more embodiments, this blending methodology utilizes these excess lighter fractions for producing LSDBs. While this would help to consume the excess supply of lighter fractions, the low carbon gasoline type distillates are also less expensive compared to gasoline or upgraded products like VLSFO. Furthermore, embodiments herein utilize residual fractions that are intermediate streams. Other residual streams, which are either byproducts or not useful are included in the modeling to reduce the cost. The list of streams that are utilized as a set of input materials for blending is as shown in Table 3. Selected streams are blended so that the blended fuel can satisfy the pre-defined property targets, which are determined using the IMO specified properties including sulfur concentration. Empirical models can fairly predict the marine fuel properties such as viscosity, density, and sulfur content. However, the models cannot predict the blend stability, which needs to be understood to predict the usefulness of the formulated fuel. When residuals are mixed with distillates, care needs to be taken to avoid blend instability and sludge formation because of the wide range of fuel properties. Therefore, the streams should be blended based on a rational basis that includes a technical analysis of stability and sludge formation in addition to cost and other properties.

TABLE 3

Residual and distillate input stream properties

| | Composition | | | | | | | | | |
|---|---|---|---|---|---|---|---|---|---|---|
| | Residuals (fuel oil) | | | | | | Heavy | Distillates | | |
| Property | Arab Light crude Stream 1 | Vacuum Gas Oil VGO Stream 2 | De-asphalted Oil DAO Stream 3 | Residual Crude Oil RCO Stream 4 | Atmospheric residue Stream 5 | Heavy Fuel Oil HFO 180 Stream 6 | Light Cycle Oil HLCO Stream 7 | Diesel Stream 8 | Heavy naphtha Stream 9 | Light Cycle Oil LCO Stream 10 |
| Viscosity (cst) | 6.8 | 35.5 | 176.4 | 609.5 | 343.0 | 180 | 4.6 | 3.3 | 0.62 | 2.6 |
| Density (kg/m3)) | 859 | 918 | 925 | 949 | 958 | 991 | 992 | 849 | 761 | 926.4 |
| Sulfur (% mass) | 1.9 | 1.6 | 2.1 | 3.4 | 2.3 | 3.5 | 1.40 | 1.5 | 0.0002 | 0.89 |

Empirical models can readily predict the marine fuel properties but do not offer a way to predict the blend stability of LSDBs. Predicting the stability of blended fuels requires more detailed modeling or experimental study. In one or more embodiments, an advanced high level refinery model was used to conduct the technical analysis and using a dedicated fuel oil blending model, the IMO specified fuel properties can be predicted. Furthermore, the model used fuel oil blend stability correlations to predict the blend stability, which allowed for a qualitative prediction of blend stability that can later be experimentally verified. The advanced refinery model encompasses both upstream and downstream processing. Only the downstream part of the model is required for the fuel oil blending study. The model is narrowed down to the blender part alone to formulate the blends, as depicted in FIG. 2 as the blender.

The following paragraphs will describe the method 300, as depicted in FIG. 3. In one or more embodiments, step 301 includes inputting properties of interest of two or more residual hydrocarbon streams. Inputting the properties of interest for the residual hydrocarbon stream may include inputting one, multiple, or all of the following properties: Average Molecular Weight (Dry), Volume Average Boiling Point, API Gravity (Dry), Specific Gravity (Dry), Watson Characterization Factor, Heteroatom content (e.g., Sulfur Content, Nitrogen Content, Oxygen content), Basic Nitrogen Content, Vapor Pressure (e.g., True Vapour Pressure (TVP), Reid Vapour Pressure), Flash Point (ASTM/PMCC and/or TBP/PMCC), Pour Point, Paraffins content (total and/or by carbon number), Olefins content (total and/or by carbon number), Naphthenes content (total and/or by carbon number), Aromatics content (total and/or by carbon number or type of aromatic (mono, di, tri, etc.)), Metals content (e.g., Nickel Content, Vanadium Content, Iron Content, Sodium Content, Copper Content, etc.), Conradson Carbon Content, Asphaltenes Content, Aromatic Blending Number, Viscosity (e.g., Kinematic viscosity or intrinsic viscosity, which may be measured at one or more standard measurement conditions), Carbon To Hydrogen Ratio, Mercaptan Sulfur Content, Distillation Curve Values (e.g., TBP, ASTM D1160, ASTM D86, or others, which may be input at various amounts or percentages boiled (1%, 5%, 10%, 15%, etc., up to 90%, 95%, 99%)), Aniline Point, Core Aromatics content, Core Naphthenes content, Bromine Number, Refractive Index, Mass Lower Heating Value, Cloud Point, Freeze Point, Cetane Index, Cetane Number, Smoke Point, Flash Point, RON (Clear), MON (Clear), and Road Octane.

Inputting the properties of interest for the residual hydrocarbon stream may include inputting one, multiple, or all of the following properties: Molecular Weight (Dry), Volume Average Boiling Point [° F.], API Gravity (Dry), Specific Gravity (Dry), Watson Characterization Factor [K], Sulfur Content [wt %], Nitrogen Content [wt %], Basic Nitrogen Content [wt %], TVP [psia], Reid Vapour Pressure [psia], Flash Point ASTM/PMCC [° F.], Flash Point TBP/PMCC [° F.], Pour Point [° F.], Paraffins by Vol [vol %], Olefins by Vol [vol %], Naphthenes by Vol [vol %] Aromatics by Vol [vol %], Nickel Content [ppmwt], Vanadium Content [ppmwt], Iron Content [ppmwt], Sodium Content [ppmwt], Copper Content [ppmwt], Conradson Carbon Content [wt %], Asphaltenes Content [wt %], Aromatic Blending Number, Viscosity (Kinematic) at 122 F [cSt], Viscosity (Kinematic) at 212 F [cSt], C To H Ratio [wt %], Mercaptan Sulfur Content [wt %], Distillation TBP Vol_01 [° F.], Distillation TBP Vol_05 [° F.], Distillation TBP Vol_10 [° F.], Distillation TBP Vol_30 [° F.], Distillation TBP Vol_50 [° F.], Distillation TBP Vol_70 [° F.], Distillation TBP Vol_90 [° F.], Distillation TBP Vol_95 [° F.], Distillation TBP Vol_99 [° F.], Naphthenes by Wt [wt %], Aromatics by Wt [wt %], Mono-Aromatics by wt [wt %], Di-Aromatics by wt [wt %], Tri+-Aromatics by wt [wt %], Aniline Point [° F.], Core Aromatics [wt %], Core Naphthenes [wt %], Bromine Number, Refractive Index, Mass Lower Heating Value [Btu/lb]. Distillation ASTM D1160_01 [° F.], Distillation ASTM D1160_05 [° F.], Distillation ASTM D1160_10 [° F.], Distillation ASTM D1160_30 [° F.], Distillation ASTM D1160_50 [° F.], Distillation ASTM D1160_70 [° F.], Distillation ASTM D1160_90 [° F.], Distillation ASTM D1160_95 [° F.], Distillation ASTM D1160_99 [° F.], Cloud Point [° F.], Freeze Point [° F.], Cetane Index D4737, Cetane Index D976-80, Cetane Number ASTM D4737, Cetane Number ASTM D976-80, Viscosity (Kinematic)_30 [cSt], Distillation ASTM D86_01_1 [° F.], Distillation ASTM D86_05_1 [° F.], Distillation ASTM D86_10_1 [° F.], Distillation ASTM D86_30_1 [° F.], Distillation ASTM D86_50_1 [° F.], Distillation ASTM D86_70_1 [° F.], Distillation ASTM D86_90_1 [° F.], Distillation ASTM D86_95_1 [° F.], Distillation ASTM D86_99_1 [° F.], Smoke Point [in], Flash Point TBP/ABEL [° F.], Viscosity (Kinematic)_0-20 [cSt], RON (Clear), MON (Clear), Road Octane, C6 Paraffins By Vol [vol %], C6 Olefins By Vol [vol %], C6 Naphthenes By Vol [vol %], Benzene By Vol [vol %], C7 Paraffins By Vol [vol %], C7 Olefins By Vol [vol %]. C7 Naphthenes By Vol [vol %], Toluene By Vol [vol %], C8 Paraffins By Vol [vol %], C8 Olefins By Vol [vol %], C8 Naphthenes By Vol [vol %], C8 Aromatics By Vol [vol %], C9 Paraffins By Vol [vol %], C9 Olefins By Vol [vol %], C9 Naphthenes By Vol [vol %], C9 Aromatics By Vol [vol %], C10 Paraffins By Vol [vol %], C10 Olefins By Vol [vol %], C10 Naphthenes By Vol [vol %], C10 Aromatics By Vol [vol %], C11 Paraffins By Vol [vol %], C11 Olefins By Vol [vol %], C11 Naphthenes By Vol [vol %], C11 Aromatics By Vol [vol %], C12 Paraffins By Vol [vol %], C12 Olefins By Vol [vol %], C12 Naphthenes By Vol [vol %], C12 Aromatics By Vol [vol %], C13 Paraffins By Vol [vol %], C13 Olefins By Vol [vol %], C13 Naphthenes By Vol [vol %], C13 Aromatics By Vol [vol %], C14 Paraffins By Vol [vol %], and C14 Olefins By Vol [vol %]. The properties noted above may be measured via analysis of samples obtained from various streams in a refinery. When necessary or needed, some of the properties may be estimated for input, such as based on historical plant data, the particular feed being used, or related properties. As the feeds to the refinery change over time, the input data may be updated routinely based on an assay of the feed or lab data, for example, such that the blends being produced continue to meet LSDB specifications.

Step 303 includes inputting properties of interest of two or more distillate hydrocarbon streams. Inputting the properties of interest for the distillate hydrocarbon stream may include inputting one, multiple, or all of the following properties: Average Molecular Weight (Dry), Volume Average Boiling Point, API Gravity (Dry), Specific Gravity (Dry), Watson Characterization Factor, Heteroatom content (e.g., Sulfur Content, Nitrogen Content, Oxygen content), Basic Nitrogen Content, Vapor Pressure (e.g., Truc Vapour Pressure (TVP), Reid Vapour Pressure), Flash Point (ASTM/PMCC and/or TBP/PMCC), Pour Point, Paraffins content (total and/or by carbon number), Olefins content (total and/or by carbon number), Naphthenes content (total and/or by carbon number), Aromatics content (total and/or by carbon number or type of aromatic (mono, di, tri, etc.)), Metals content (e.g., Nickel Content, Vanadium Content, Iron Content, Sodium Content, Copper Content, etc.), Conradson Carbon Content, Asphaltenes Content, Aromatic Blending Number, Viscosity (e.g., Kinematic viscosity or intrinsic viscosity, which may be measured at one or more standard measurement conditions), Carbon To Hydrogen Ratio, Mercaptan Sulfur Content, Distillation Curve Values (e.g., TBP, ASTM D1160, ASTM D86, or others, which may be input at various amounts or percentages boiled (1%, 5%, 10%, 15%, etc., up to 90%, 95%, 99%)), Aniline Point, Core Aromatics content, Core Naphthenes content, Bromine Number, Refractive Index, Mass Lower Heating Value, Cloud Point, Freeze Point, Cetane Index, Cetane Number, Smoke Point, Flash Point, RON (Clear), MON (Clear), and Road Octane.

Inputting the properties of interest for the distillate hydrocarbon stream may include inputting one, multiple, or all of the following properties: Molecular Weight (Dry), Volume Average Boiling Point [° F.], API Gravity (Dry), Specific Gravity (Dry), Watson Characterization Factor [K], Sulfur Content [wt %], Nitrogen Content [wt %], Basic Nitrogen Content [wt %], TVP [psia], Reid Vapour Pressure [psia], Flash Point ASTM/PMCC [° F.], Flash Point TBP/PMCC [° F.], Pour Point [° F.], Paraffins by Vol [vol %], Olefins by Vol [vol %], Naphthenes by Vol [vol %] Aromatics by Vol [vol %], Nickel Content [ppmwt], Vanadium Content [ppmwt], Iron Content [ppmwt], Sodium Content [ppmwt], Copper Content [ppmwt], Conradson Carbon Content [wt %], Asphaltenes Content [wt %], Aromatic Blending Number, Viscosity (Kinematic) at 122 F [cSt], Viscosity (Kinematic) at 212 F [cSt], C To H Ratio [wt %], Mercaptan Sulfur Content [wt %], Distillation TBP Vol_01 [° F.], Distillation TBP Vol_05 [° F.], Distillation TBP Vol_10 [° F.], Distillation TBP Vol_30 [° F.], Distillation TBP Vol_50 [° F.], Distillation TBP Vol_70 [° F.], Distillation TBP Vol_90 [° F.], Distillation TBP Vol_95 [° F.], Distillation TBP Vol_99 [° F.], Naphthenes by Wt [wt %], Aromatics by Wt [wt %], Mono-Aromatics by wt [wt %], Di-Aromatics by wt [wt %], Tri+-Aromatics by wt [wt %], Aniline Point [° F.], Core Aromatics [wt %], Core Naphthenes [wt %], Bromine Number, Refractive Index, Mass Lower Heating Value [Btu/lb], Distillation ASTM D1160_01 [° F.], Distillation ASTM D1160_05 [° F.], Distillation ASTM D1160_10 [° F.], Distillation ASTM D1160_30 [° F.]. Distillation ASTM D1160_50 [° F.], Distillation ASTM D1160_70 [° F.], Distillation ASTM D1160_90 [° F.], Distillation ASTM D1160_95 [° F.], Distillation ASTM D1160_99 [° F.], Cloud Point [° F.], Freeze Point [° F.], Cetane Index D4737, Cetane Index D976-80, Cetane Number ASTM D4737, Cetane Number ASTM D976-80, Viscosity (Kinematic)_30 [cSt], Distillation ASTM D86_01_1 [° F.], Distillation ASTM D86_05_1 [° F.], Distillation ASTM D86_10_1 [° F.], Distillation ASTM D86_30_1 [° F.], Distillation ASTM D86_50_1 [° F.], Distillation ASTM D86_70_1 [° F.], Distillation ASTM D86_90_1 [° F.], Distillation ASTM D86_95_1 [° F.], Distillation ASTM D86_99_1 [° F.], Smoke Point [in], Flash Point TBP/ABEL [° F.], Viscosity (Kinematic)_0-20 [cSt], RON (Clear), MON (Clear), Road Octane, C6 Paraffins By Vol [vol %], C6 Olefins By Vol [vol %], C6 Naphthenes By Vol [vol %], Benzene By Vol [vol %], C7 Paraffins By Vol [vol %], C7 Olefins By Vol [vol %], C7 Naphthenes By Vol [vol %], Toluene By Vol [vol %], C8 Paraffins By Vol [vol %], C8 Olefins By Vol [vol %], C8 Naphthenes By Vol [vol %], C8 Aromatics By Vol [vol %], C9 Paraffins By Vol [vol %], C9 Olefins By Vol [vol %], C9 Naphthenes By Vol [vol %], C9 Aromatics By Vol [vol %], C10 Paraffins By Vol [vol %], C10 Olefins By Vol [vol %], C10 Naphthenes By Vol [vol %], C10 Aromatics By Vol [vol %], C11 Paraffins By Vol [vol %], C11 Olefins By Vol [vol %], C11 Naphthenes By Vol [vol %], C11 Aromatics By Vol [vol %], C12 Paraffins By Vol [vol %], C12 Olefins By Vol [vol %], C12 Naphthenes By Vol [vol %], C12 Aromatics By Vol [vol %], C13 Paraffins By Vol [vol %], C13 Olefins By Vol [vol %], C13 Naphthenes By Vol [vol %], C13 Aromatics By Vol [vol %], C14 Paraffins By Vol [vol %], and C14 Olefins By Vol [vol %]. The properties noted above may be measured via analysis of samples obtained from various streams in a refinery. When necessary or needed, some of the properties may be estimated for input, such as based on historical plant data, the particular feed being used, or related properties. As the feeds to the refinery change over time, the input data may be updated routinely based on an assay of the feed or lab data, for example, such that the blends being produced continue to meet LSDB specifications.

While units for the above input values are noted, one skilled in the art can appreciate that models according to embodiments herein may alternatively include similar calculations based on input values using equivalent or alternative units (e.g., mass % for vol % or mol %, or ° C. for ° F., for example).

Step 305 includes inputting target LSDB properties into the model, completing the input information the model needs to determine an LSDB composition. Inputting the desired LSDB properties into the model may include inputting one, multiple, or all of the following properties: Viscosity at 40° C. (cSt), Density at 15° C. (kg/m3), Micro carbon residue (% m/m), Ash (% m/m), Vanadium (mg/kg), Cetane index, Water (% v/v), Flash point (° C.), Pour point (° C.), Cloud point (° C.), Sulfur (% m/m), Total sediment (% m/m), Acid number (mg KOH/g), Oxidation stability (g/m3), and Hydrogen sulfide (mg/kg).

Step 307 includes modeling the composition properties and the model outputting a determined composition. Model constraints may include the desired LSDB properties, such as those specifications prescribed by ISO for classification of the resulting blend as a low sulfur distillate fuel. The model may also be constrained by selecting various streams as being available for formulating the blend; for example, when demand for diesel is high, the diesel stream may be removed from the streams available to formulate the blend, and the model will formulate the LSDB using other available distillate streams. The constraints may also include limiting amounts available from various streams or requiring usage of or minimum percentages of various refinery streams to formulate the blends. Other various constraints on the inputs may also be provided, such as minimum or maximum distillate content, minimum or maximum residue content, as well as other constraints on the blended stream properties or available refinery streams used to formulate the blended stream. To provide a safety factor for the blend, it may be desirable to constrain one or more desired values of the determined blend composition to minimums and maximums within the ISO specified ranges, such as 5%, 10%, 15% or 20% above or below an extremum, so as to avoid a determined blend composition that may be at an extremum of a range for one or more required ISO properties, and which may potentially be commercially unfavorable to produce.

The model calculation methodology may include varying a content (e.g., volume or mass percentage) of the available refinery streams within a blend to meet the model constraints, thereby formulating a blended stream having the desired LSDB properties. The calculation methodology includes calculation of blended properties based on the properties of the input streams, and may include various formulae that are used to arrive at an average or expected property of the blend based on the output blending ratio of the determined streams to be used in the determined blend composition. For example, modeled boiling curves for the blended stream may be calculated based on the volume fractions of the input streams and their respective boiling curves or component analyses; other various LSDB properties may be estimated based on the inputs listed above, and the blend properties may be calculated based on respective volume, mass, or mole fractions of the streams or stream compositions (input or estimated via the simulation calculation methodology) as well as any correlative equations or factors, many of which are known in the art, that may be used to more accurately reflect the blend property being calculated.

The calculation methodology may provide for optimization of the resulting blend streams and their properties to meet the one or multiple input model constraints. Through the calculations outlined above, the model may optimize the blending to meet the specifications (desired output properties), where the blender objective function is configured or set to meet the output properties (which are constrained in the model). Outputs of the model may include the determined composition as well as the blending ratio of the residual and distillate hydrocarbon streams to arrive at the determined composition. Other outputs may include various estimated properties of the determined blend composition.

Step 309 includes using a predictive stability model to predict the stability of the output blend composition. Stability indicates the ability of asphaltene to remain dispersed in the existing liquid phase. Embodiments herein utilize a stability value, such as a P-value, to assess the stability of the blend, and the ability of a blend to prevent or minimize asphaltene precipitation. Calculating a projected blend stability includes using the aromatic blending number of the model output blend fractions and blend ratios to determine the stability value (e.g., a P-value) of the blend and to thus provide an initial estimate of blend stability, which can later be verified by experimental data. In some embodiments, step 309 may also include estimation of the potential for sludge formation (potential for precipitation of various components) and/or the potential for separation of one or more of the various fractions used to formulate the blend (stratification of the blended composition), and/or to estimate the compatibility of the output LSDB for compatibility when mixed with other various marine fuels. As known in the art, fuels available from port to port may vary, and mixing of such fuels within a fuel tank may unwantedly result in compatibility issues or sludge formation, each of which may result in engine or fuel feed line issues, clogged fuel filters, etc.; embodiments herein may estimate the potential for the calculated LSDB blends for such undesired properties, which may also be verified experimentally. Stability calculations may additionally or alternatively be based on aromatics content, asphaltenes content, and other input values for the respective streams being blended.

Step 311 includes forming a low-sulfur distillate blend based on the determined composition by mixing the determined streams. The mixing of the determined streams may include blending of the selected refinery streams at the output compositional ratios to arrive at the output blend and the desired LSDB. Mixing can be performed by combining the streams within pipes or other flow channels, which may or may not include static mixers, or within blend tanks, which may be agitated to promote mixing of the various streams to arrive at a uniformly blended composition. One advantage of this method is the reliance on economic and facile simple mixing of the determined streams, avoiding costlier processing methods.

Step 313 includes evaluating the LSDB to confirm physical properties and blend stability predicted by the model. This evaluation may also include evaluation of the properties required by IMO as listed in Tables 1 and 2.

For the input of the model, the streams listed in Table 3 and a few additional streams are linked as feed streams. The detailed properties of the individual streams are then updated in the fuel library of the model. Note that while Table 3 only shows viscosity, density, and sulfur content, the model incorporates the IMO specified properties as shown in Table 1 and Table 2 for each of the individual streams.

The model has robust property predication capabilities. The properties of the resultant LSDBs are calculated from the individual properties of the feed streams. The accurate properties of the input streams ensure the robustness of the predicted fuel properties. In one or more embodiments, this strategy formulates LSDBs that can be categorized under distillate fuel categories. In these cases, the model is constrained to satisfy the IMO specified distillate fuel properties (Table 2). The fuel oil blend stability correlations are incorporated in the model to predict the blend stability, calculated as a P-value. If the P value is greater than 1, the blends will be stable and if the P value is less than 1, the blends will be unstable.

The model can either be constrained with certain inputs or the model can automatically pick the input feed streams and perform the fuel formulation. The model can readily pick the streams from the set of input materials to meet the sulfur constraint and other fuel properties automatically, or the model can be forced to select modeler defined streams. This approach is purely based on the modeler's judgement and choice. Since the model is constrained to meet the distillate fuel properties specification, the formulated LSDBs will be compliant. When performing the technical analysis, a cost analysis is neglected if the price of certain streams is unavailable. However, from the price data of other available streams, the costs of the LSDBs are inferred and are expected to be economically viable.

Low-Sulfur Distillate Blend Properties and Performance

The low-sulfur distillate blends of the current invention comply with the IMO global sulfur cap of 0.5 wt % and meet ISO 8217 specified fuel properties for their respective categories. Depending on the specifics of the LSDB composition, the LSDB may be categorized under DMX, DMB, DMA, or DMZ distillate fuel grades according to ISO 8217 as shown in Table 2. In one or more embodiments the LSDBs also meet the IMO sulfur cap for ECAs of 0.1 wt %. Therefore, the LSDBs proposed herein allow for fuels that will meet the sulfur regulatory requirements and lead to a reduction in $SO_x$ emissions as required by the IMO.

The cost of a LSDB is an important property in addition to the technical properties of the LSDB. In one or more embodiments, the cost of a determined composition may be calculated. The calculated cost of the determined composition may be compared to the cost of other viable alternative fuels, such as VLSFO. If the calculated cost of the determined composition is lower than other viable alternative fuels, the LSDB may be formed for evaluation of physical properties or marine engine use.

In addition to overall cost being an important factor for proper fuel selection, several technical issues must be addressed for proper marine engine function. Stability is required for any proposed fuel, and any separation into constituent components would restrict use as a marine fuel. Therefore, in one or more embodiments, the low-sulfur distillate blends of this invention are stable without any separation of blend components. Stability indicates the ability of asphaltene to remain dispersed in the existing liquid phase. Ensuring stability in these LSDBs is challenging since the lowest sulfur distillate streams are light distillates with lower viscosities compared to residual streams, and large differences in component viscosity can result in blend compatibility issues. Therefore, blend stability is ensured through proper wholistic selection of both distillate and residual streams in the LSDB.

Furthermore, in one or more embodiments, the low-sulfur distillate blends do not readily form sludge, and otherwise meet marine engine compatibility requirements. Sludge formation in fuel tanks is a common issue when distillates are blended with residuals in marine engine use. Asphaltenes in residuals are stable when surrounded by a significant aromatic portion. If the aromatic content is reduced by mixing with high paraffinic fuel, it is possible that agglomeration of asphaltene begins and an asphaltene sludge forms. The LSDBs of the present invention are formulated with suitable proportions of residuals and distillates so that sludge formation is minimized. General engine compatibility is also ensured through a proper wholistic selection of both residual and distillate components, as lower viscosities and cold flow properties can cause engine compatibility issues as well as fuel injection system issues such as is the case with the current VLSFO. Sludge formation due to asphaltene precipitation was predicted by P-value.

In one or more embodiments, the LSDBs exhibit a reduced viscosity in the range of distillate fuels (1.4-11 cSt), and boiling point ranges that enhances fuel atomization, evaporation, and air/fuel mixing while meeting IMO specifications. A reduced viscosity will improve fuel atomization and other spray characteristics, and a reduced boiling range will enhance fuel vaporization and improve air/fuel mixing. Combustion is improved and gaseous emissions are reduced with these enhancements in fuel atomization, evaporation, and air/fuel mixing. Therefore, LSDBs can be formulated with desirable fuel atomization and air/fuel mixing properties through proper fuel selection.

In one or more embodiments, the LSDBs contain both paraffinic and aromatic components.

In one or more embodiments, the LSDB properties avoid the use of after treatment strategies such as a scrubber. While avoiding any additional after treatment would be beneficial, it is a priority to eliminate the use of scrubbers. Elimination of scrubbers is desirable as scrubbers are not compatible with certain low carbon fuels. Also, where scrubbers could theoretically be used to reduce $SO_x$ emissions, there are regulatory restrictions due to water pollution caused by open loop scrubber systems. In order to meet regulatory requirements moving forward and to ensure compatibility with low carbon fuels, scrubbers must necessarily be avoided in future marine engine design.

The LSDB's improved fuel properties enable engine operation based on advanced low temperature combustion modes. Utilizing these advanced low temperature combustion modes simultaneously reduces $NO_x$ and particulate matter emissions. Thus, besides the intended benefits of reduced $SO_X$ emissions, these other emissions are reduced while engine efficiency is improved. Furthermore, the life cycle $CO_2$ emissions of marine engines are reduced when utilizing LSDBs. This is due to the levels of low carbon distillate fractions in the LSDBs.

Example Low-Sulfur Distillate Blends and their Advantages

Figure 4:
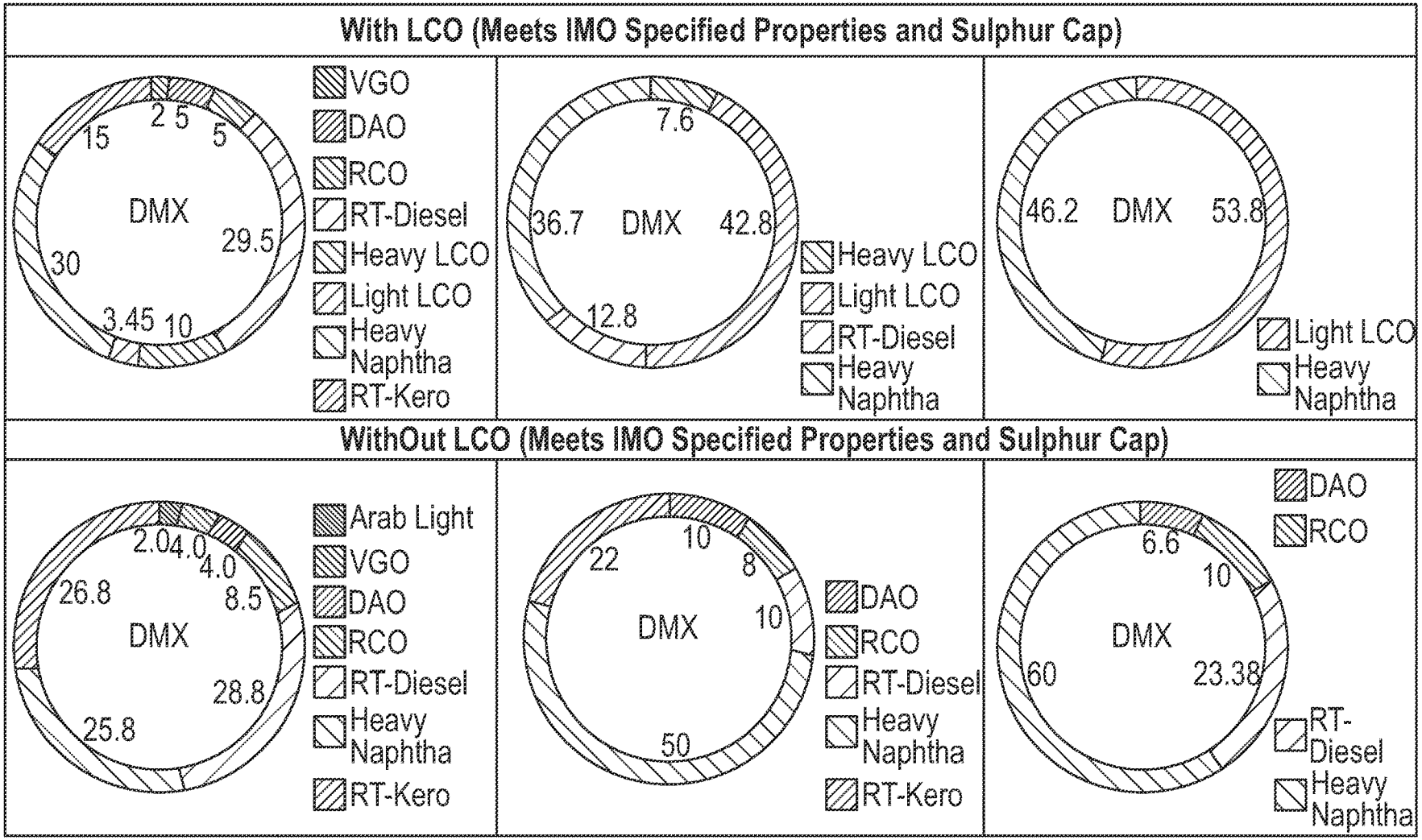
FIG. 4 is a chart depicting suitable LSDBs under the DMX fuel category in accordance with one or more embodiments of the present disclosure.
Figure 5:
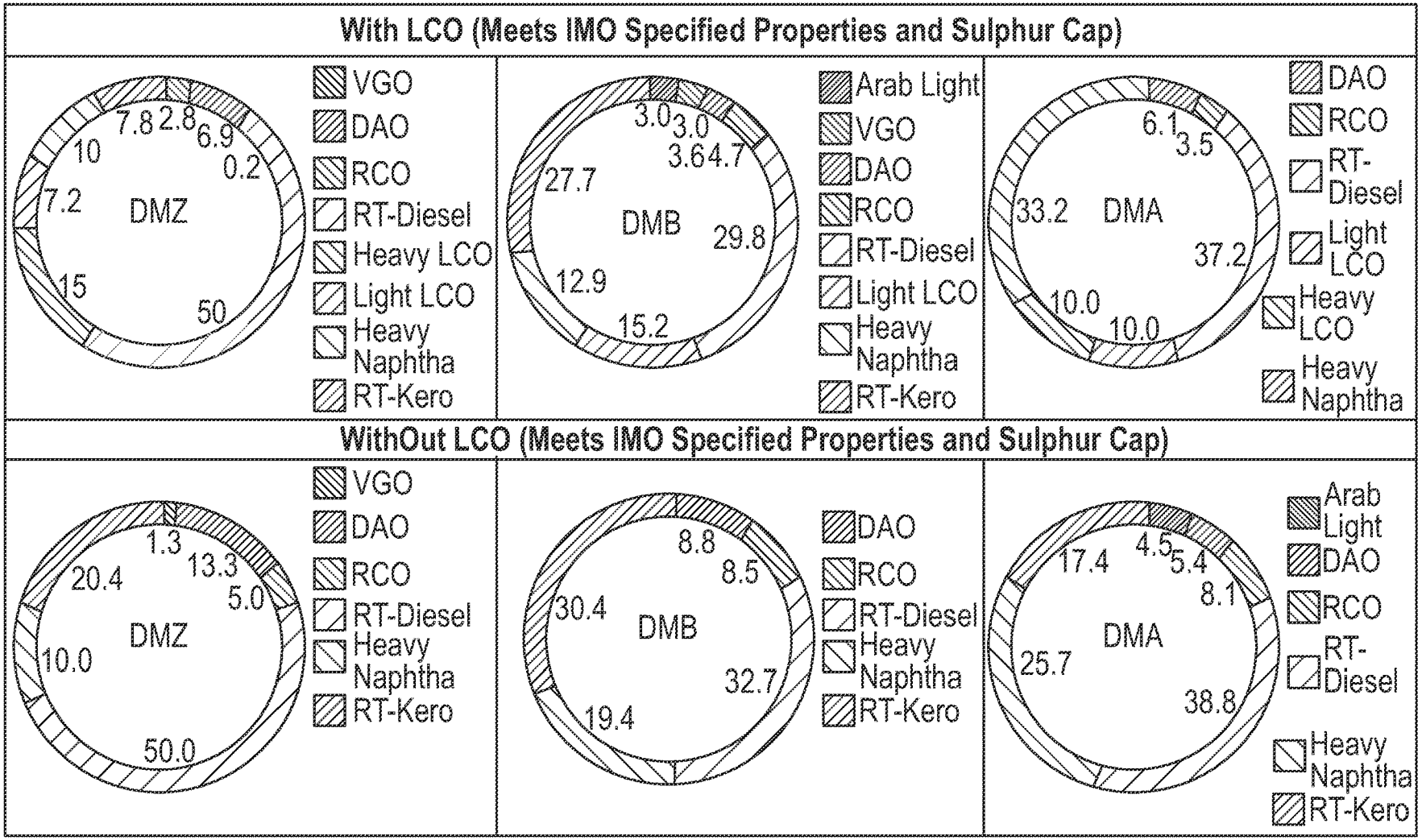
FIG. 5 is a chart depicting suitable LSDBs under the DMA, DMB, and DMZ fuel categories in accordance with one or more embodiments of the present disclosure.

Based on the blending methodology described above, several LSDBs were formulated. The LSDBs formulated under the DMX category are shown in FIG. 4. Similarly, LSDBs under DMA, DMB and DMZ categories are shown in FIG. 5. All the formulated LSDBs meet the IMO specified fuel properties with sulfur content of about 0.5 wt % and are stable. The model predicted properties of LSDBs formulated to adhere to the different distillate fuel grades are shown in Table 4. In FIGS. 4 and 5, the upper row LSDBs contain LCO whereas the lower row LSDBs are formulated without LCO. Note that the lighter distillate fractions such as diesel, gasoline and kerosene are expensive compared to the residuals or intermediate fuel streams. Therefore, in optimizing the blend fuel formulation, diesel and kerosene are avoided when moving from left to right in both upper and lower rows of FIG. 4 and FIG. 5. Therefore, the most economically viable LSDBs are in the upper and lower right corners of FIGS. 4 and 5. These formulated LSBDs can both technically and economically overcome the drawbacks of VLSFO.

TABLE 4

Model predicted properties of LSDBs under DMX, DMA, DMB, and DMZ categories

| Property | DMX | DMA | DMB | DMZ |
|---|---|---|---|---|
| Specific gravity | 0.86 | 0.89 | 0.9 | 0.89 |
| Sulfur Content (wt %) | 0.5 | 0.5 | 0.5 | 0.5 |
| Flash Point (° C.) (Calculated) | 86.5 | 86.8 | 85.2 | 104.9 |
| Viscosity (Kinematic in cst)) | 1.9 | 2 | 2 | 2.9 |
| P-value (blend stability) | 1.0 | 1.07 | 1.0 | 1.01 |

Embodiments of the present disclosure may provide at least one of the following advantages. Possibly the most important of the advantages of these proposed LSDBs are their adherence to new, lower IMO sulfur regulations. Blends can be formulated to adhere to either the 0.1 wt % sulfur cap for ECAs or the 0.5 wt % sulfur cap for the global region, with the lower sulfur blends likely to utilize greater amounts of higher cost inputs. The method can be used to determine LSDBs that are categorizable under either the DMX, DMA, DMB, and DMZ fuel grades, allowing for facile formulation of specific fuel grades according to ISO 8217. The determined LSDB compositions are formulated to have desired viscosities and boiling point ranges for use in marine engines as discussed previously. Because of the decreased aromatic content compared to existing fuels in use for marine engines, the LSDBs of the present invention will produce fewer particulate matter emissions. The life cycle $CO_2$ emissions of marine engines using the proposed LSDBs are also reduced due to the levels of low carbon distillate fractions in the LSDBs. The method is able to produce LSDBs that are stable without any separation of components and do not readily form sludge, both key requirements for implementation as marine fuel. Utilizing LSDBs will allow for marine engines to operate in advanced low temperature combustion modes that simultaneously reduce particulate matter and $NO_x$ emissions. This invention can provide economically viable alternatives to current low sulfur fuels because of its simple processing and ability to model properties along with calculations of cost. Embodiments herein can provide economically viable low-sulfur fuels compared to VLSFO, because of the high cost of producing VLSFO, and has the added advantage of being able to formulate new low-cost, low-sulfur fuels as input fuel prices continually fluctuate.

Useful LSDBs according to one or more embodiments will be described below. To be considered a useful LSDB, the blend should comprise less than 0.5 wt % sulfur to satisfy the IMO global sulfur cap, the blend should meet ISO 8217 specified fuel properties, the blend should be stable without any separation of blend components, and the blend should not readily form sludge, as predicted by P-value. A possible useful LSDB may comprise 60 to 95 wt % distillate fuels and 5 to 40 wt % residual fuels.

Useful LSDBs in the DMX category made using LCO may include 30-50 wt % heavy naphtha, 40-60 wt % LCO, 0-15 wt % diesel, and 0-10 wt % heavy LCO. Useful LSDBs in the DMX category made using LCO may also include 40-50 wt % heavy naphtha and 50-60 wt % LCO, or 45-48 wt % heavy naphtha and 52-55 wt % LCO.

Useful LSDBs in the DMX category made without using LCO include 40-60 wt % heavy naphtha, 15-30 wt % kerosene, 5-15 wt % DAO, 5-15 wt % RCO, and 5-15 wt % diesel. Useful LSDBs in the DMX category made without using LCO may also include 50-70 wt % heavy naphtha, 17-27 wt % diesel, 5-15 wt % RCO, and 0-10 wt % DAO, or 58-62 wt % heavy naphtha, 22-25 wt % diesel, 9-11 wt % RCO, and 5-7 wt % DAO.

Useful LSDBs in the DMA, DMB and DMZ categories made using LCO may include 25-35 wt % diesel, 10-20 wt % LCO, 10-15 wt % heavy naphtha, 22-32 wt % kerosene, 0-5 wt % Arab light, 0-5 wt % VGO, 2-8 wt % DAO, and 0-10 wt % RCO. Useful LSDBs in the DMA, DMB and DMZ categories made using LCO may also include 33-43 wt % diesel, 5-15 wt % LCO, 5-15 wt % heavy LCO, 28-38 wt % heavy naphtha, 3-9 wt % DAO, and 0-6% RCO, or 35-38 wt % diesel, 9-11 wt % LCO, 9-11 wt % heavy LCO, 32-34 wt % heavy naphtha, 5-7 wt % DAO, and 4-6% RCO.

Useful LSDBs in the DMA, DMB and DMZ categories made without using LCO may include 28-38 wt % diesel, 15-25 wt % heavy naphtha, 25-35 wt % RT kerosene, 5-15 wt % DAO, and 5-15 wt % RCO. Useful LSDBs in the DMA, DMB and DMZ categories made without using LCO may also include 33-43 wt % diesel, 20-30 wt % heavy naphtha, 12-22 wt % kerosene, 0-10 wt % Arab light, 0-10 wt % DAO, and 3-13 wt % RCO, or 38-40 wt % diesel, 24-26 wt % heavy naphtha, 16-18 wt % kerosene, 3.5-5.5 wt % Arab light crude oil, 4-6 wt % DAO, and 7-9 wt % RCO.

Although only a few example embodiments have been described in detail above, those skilled in the art will readily appreciate that many modifications are possible in the example embodiments without materially departing from this invention. Accordingly, all such modifications are intended to be included within the scope of this disclosure as defined in the following claims.

What is claimed:

1. A method for blending fuel streams to produce a low-sulfur distillate blend, the method comprising:

formulating a blend composition using a model, comprising:

inputting into the model properties of interest of two or more residual hydrocarbon streams of a refinery;

inputting into the model properties of interest of two or more distillate hydrocarbon streams of a refinery;

inputting into the model target low-sulfur distillate blend properties; and modeling composition properties to output a determined composition, having a blending ratio of one or more of the distillate hydrocarbon streams and one or more of the residual hydrocarbon streams, predicted to satisfy the target low-sulfur distillate blend properties;

calculating a projected stability of the determined composition using a predictive stability model; and forming a low-sulfur distillate blend based on the determined composition by mixing determined input streams at the blending ratio.

2. The method of claim 1, wherein calculating a projected stability comprises using an aromatic blending number of the determined input streams to determine a stability value.

3. The method of claim 1, wherein the modeling composition properties comprises: calculation of low-sulfur distillate blend properties based on the distillate hydrocarbon stream properties and the residual hydrocarbon stream properties, wherein the calculation of low-sulfur distillate blend properties comprises calculations to arrive at average or expected properties of the blend; and optimizing fuel blending to meet the target low-sulfur distillate blend properties, wherein optimizing fuel blending comprises configuring a blender objective function to meet the target low-sulfur distillate blend properties.

4. The method of claim 1, further comprising calculating a cost of the determined composition.

5. The method of claim 4, further comprising comparing the cost of the determined composition to a cost of very low-sulfur fuel oil, and if the cost of the determined composition is less than the cost of very low-sulfur fuel oil, evaluating the low sulfur distillate blend to confirm physical properties and blend stability.

6. The method of claim 4, further comprising comparing the cost of the determined composition to a cost of very low-sulfur fuel oil, and if the cost of the determined composition is less than the cost of very low-sulfur fuel oil, forming the low sulfur distillate blend.

7. The method of claim 1, further comprising evaluating the low sulfur distillate blend to confirm physical properties and blend stability.

8. The method of claim 1, wherein the properties of interest of the two or more distillate hydrocarbon streams and the properties of interest of the two or more residue hydrocarbon streams each include one or more of: Average Molecular Weight (Dry), Volume Average Boiling Point, API Gravity (Dry), Specific Gravity (Dry), Watson Characterization Factor, Heteroatom content, Basic Nitrogen Content, Vapor Pressure, Flash Point, Pour Point, Paraffins content, Olefins content, Naphthenes content, Aromatics content, Metals content, Conradson Carbon Content, Asphaltenes Content, Aromatic Blending Number, Viscosity, Carbon To Hydrogen Ratio, Mercaptan Sulfur Content, Distillation Curve Values, Aniline Point, Core Aromatics content, Core Naphthenes content, Bromine Number, Refractive Index, Mass Lower Heating Value, Cloud Point, Freeze Point, Cetane Index, Cetane Number, Smoke Point, Flash Point, RON (Clear), MON (Clear), and Road Octane.

9. The method of claim 1, wherein the properties of interest of the two or more distillate hydrocarbon streams include one or more of Molecular Weight (Dry), Volume Average Boiling Point [° F.], API Gravity (Dry), Specific Gravity (Dry), Watson Characterization Factor [K], Sulfur Content [wt %], Nitrogen Content [wt %], Basic Nitrogen Content [wt %], True Vapor Pressure (TVP) [psia], Reid Vapour Pressure [psia], Flash Point ASTM/PMCC [° F.], Flash Point TBP/PMCC [° F.], Pour Point [° F.], Paraffins by Vol [vol %], Olefins by Vol [vol %], Naphthenes by Vol [vol %] Aromatics by Vol [vol %], Nickel Content [ppmwt], Vanadium Content [ppmwt], Iron Content [ppmwt], Sodium Content [ppmwt], Copper Content [ppmwt], Conradson Carbon Content [wt %], Asphaltenes Content [wt %], Aromatic Blending Number, Viscosity (Kinematic) at 122 F [cSt], Viscosity (Kinematic) at 212 F [cSt], C To H Ratio [wt %], Mercaptan Sulfur Content [wt %], Distillation TBP Vol_01 [° F.], Distillation TBP Vol_05 [° F.], Distillation TBP Vol_10 [° F.], Distillation TBP Vol_30 [° F.], Distillation TBP Vol_50 [° F.], Distillation TBP Vol 70 [° F.], Distillation TBP Vol 90 [° F.], Distillation TBP Vol 95 [° F.], Distillation TBP Vol_99 [° F.], Naphthenes by Wt [wt %], Aromatics by Wt [wt %], Mono-Aromatics by wt [wt %], Di-Aromatics by wt [wt %], Tri+-Aromatics by wt [wt %], Aniline Point [° F.], Core Aromatics [wt %], Core Naphthenes [wt %], Bromine Number, Refractive Index, Mass Lower Heating Value [Btu/lb], Distillation ASTM D1160_01 [° F.], Distillation ASTM D1160_05 [° F.], Distillation ASTM D1160_10 [° F.], Distillation ASTM D1160_30 [° F.], Distillation ASTM D1160_50 [° F.], Distillation ASTM D1160_70 [° F.], Distillation ASTM D1160_90 [° F.], Distillation ASTM D1160_95 [° F.], Distillation ASTM D1160_99 [° F.], Cloud Point [° F.], Freeze Point [° F.], Cetane Index D4737, Cetane Index D976-80, Cetane Number ASTM D4737, Cetane Number ASTM D976-80, Viscosity (Kinematic)_30 [cSt], Distillation ASTM D86_01_1 [° F.], Distillation ASTM D86_05_1 [° F.], Distillation ASTM D86_10_1 [° F.], Distillation ASTM D86_30_1 [F], Distillation ASTM D86_50_1 [° F.], Distillation ASTM D86_70_1 [° F.], Distillation ASTM D86_90_1 [° F.], Distillation ASTM D86_95_1 [° F.], Distillation ASTM D86_99_1 [° F.], Smoke Point [in], Flash Point TBP/ABEL [° F.], Viscosity (Kinematic)_0-20 [cSt], RON (Clear), MON (Clear), Road Octane, C6 Paraffins By Vol [vol %], C6 Olefins By Vol [vol %], C6 Naphthenes By Vol [vol %], Benzene By Vol [vol %], C7 Paraffins By Vol [vol %], C7 Olefins By Vol [vol %], C7 Naphthenes By Vol [vol %], Toluene By Vol [vol %], C8 Paraffins By Vol [vol %], C8 Olefins By Vol [vol %], C8 Naphthenes By Vol [vol %], C8 Aromatics By Vol [vol %], C9 Paraffins By Vol [vol %], C9 Olefins By Vol [vol %], C9 Naphthenes By Vol [vol %], C9 Aromatics By Vol [vol %], C10 Paraffins By Vol [vol %], C10 Olefins By Vol [vol %], C10 Naphthenes By Vol [vol %], C10 Aromatics By Vol [vol %], C11 Paraffins By Vol [vol %], C11 Olefins By Vol [vol %], C11 Naphthenes By Vol [vol %], C11 Aromatics By Vol [vol %], C12 Paraffins By Vol [vol %], C12 Olefins By Vol [vol %], C12 Naphthenes By Vol [vol %], C12 Aromatics By Vol [vol %], C13 Paraffins By Vol [vol %], C13 Olefins By Vol [vol %], C13 Naphthenes By Vol [vol %], C13 Aromatics By Vol [vol %], C14 Paraffins By Vol [vol %], and C14 Olefins By Vol [vol %].

10. The method of claim 1, wherein the properties of interest of the two or more residual hydrocarbon streams include one or more of Molecular Weight (Dry), Volume Average Boiling Point [° F.], API Gravity (Dry), Specific Gravity (Dry), Watson Characterization Factor [K], Sulfur Content [wt %], Nitrogen Content [wt %], Basic Nitrogen Content [wt %], TVP [psia], Reid Vapour Pressure [psia], Flash Point ASTM/PMCC [° F.], Flash Point TBP/PMCC [° F.], Pour Point [° F.], Paraffins by Vol [vol %], Olefins by Vol [vol %], Naphthenes by Vol [vol %] Aromatics by Vol [vol %], Nickel Content [ppmwt], Vanadium Content [ppmwt], Iron Content [ppmwt], Sodium Content [ppmwt], Copper Content [ppmwt], Conradson Carbon Content [wt %], Asphaltenes Content [wt %], Aromatic Blending Number, Viscosity (Kinematic) at 122 F [cSt], Viscosity (Kinematic) at 212 F [cSt], C To H Ratio [wt %], Mercaptan Sulfur Content [wt %], Distillation TBP Vol 01 [° F.], Distillation TBP Vol 05 [° F.], Distillation TBP Vol 10 [° F.], Distillation TBP Vol 30 [° F.], Distillation TBP Vol_50 [F], Distillation TBP Vol_70 [° F.], Distillation TBP Vol_90 [° F.], Distillation TBP Vol_95 [° F.], Distillation TBP Vol 99 [F], Naphthenes by Wt [wt %], Aromatics by Wt [wt %], Mono-Aromatics by wt [wt %], Di-Aromatics by wt [wt %], Tri+-Aromatics by wt [wt %], Aniline Point [° F.], Core Aromatics [wt %], Core Naphthenes [wt %], Bromine Number, Refractive Index, Mass Lower Heating Value [Btu/lb], Distillation ASTM D1160_01 [° F.], Distillation ASTM D1160_05 [° F.], Distillation ASTM D1160_10 [° F.], Distillation ASTM D1160_30 [° F.], Distillation ASTM D1160_50 [° F.], Distillation ASTM D1160_70 [° F.], Distillation ASTM D1160_90 [° F.], Distillation ASTM D1160_95 [° F.], Distillation ASTM D1160_99 [° F.], Cloud Point [° F.], Freeze Point [° F.], Cetane Index D4737, Cetane Index D976-80, Cetane Number ASTM D4737, Cetane Number ASTM D976-80, Viscosity (Kinematic)_30 [cSt], Distillation ASTM D86_01_1 [° F.], Distillation ASTM D86_05_1 [° F.], Distillation ASTM D86_10_1 [° F.], Distillation ASTM D86_30_1 [F], Distillation ASTM D86_50_1 [° F.], Distillation ASTM D86_70_1 [° F.], Distillation ASTM D86_90_1 [° F.], Distillation ASTM D86_95_1 [° F.], Distillation ASTM D86_99_1 [° F.], Smoke Point [in], Flash Point TBP/ABEL [° F.], Viscosity (Kinematic)_0-20 [cSt], RON (Clear), MON (Clear), Road Octane, C6 Paraffins By Vol [vol %], C6 Olefins By Vol [vol %], C6 Naphthenes By Vol [vol %], Benzene By Vol [vol %], C7 Paraffins By Vol [vol %], C7 Olefins By Vol [vol %], C7 Naphthenes By Vol [vol %], Toluene By Vol [vol %], C8 Paraffins By Vol [vol %], C8 Olefins By Vol [vol %], C8 Naphthenes By Vol [vol %], C8 Aromatics By Vol [vol %], C9 Paraffins By Vol [vol %], C9 Olefins By Vol [vol %], C9 Naphthenes By Vol [vol %], C9 Aromatics By Vol [vol %], C10 Paraffins By Vol [vol %], C10 Olefins By Vol [vol %], C10 Naphthenes By Vol [vol %], C10 Aromatics By Vol [vol %], C11 Paraffins By Vol [vol %], C11 Olefins By Vol [vol %], C11 Naphthenes By Vol [vol %], C11 Aromatics By Vol [vol %], C12 Paraffins By Vol [vol %], C12 Olefins By Vol [vol %], C12 Naphthenes By Vol [vol %], C12 Aromatics By Vol [vol %], C13 Paraffins By Vol [vol %], C13 Olefins By Vol [vol %], C13 Naphthenes By Vol [vol %], C13 Aromatics By Vol [vol %], C14 Paraffins By Vol [vol %], and C14 Olefins By Vol [vol %].

11. The method of claim 1, wherein the target low-sulfur distillate blend properties include one or more of Viscosity at 40° C. (cSt), Density at 15° C. (kg/m3), Micro carbon residue (% m/m), Ash (% m/m), Vanadium (mg/kg), Cetane index, Water (% v/v), Flash point (° C.), Pour point (° C.), Cloud point (° C.), Sulfur (% m/m), Total sediment (% m/m), Acid number (mg KOH/g), Oxidation stability (g/m3), and Hydrogen sulfide (mg/kg).

12. The method of claim 1, wherein the low-sulfur distillate blend exhibits a viscosity in a range of distillate fuels, between 1.4 and 11 cSt.

13. A low-sulfur distillate blend (LSDB) for marine engines comprising:

a blend of residual and distillate fuel streams; wherein:

the low-sulfur distillate blend comprises 60 to 95 wt % distillate fuels and 5 to 40 wt % residual fuels;

the low-sulfur distillate blend comprises less than 0.5 wt % sulfur, satisfying an IMO global sulfur cap of 0.5 wt % sulfur;

the low-sulfur distillate blend meets ISO 8217 specified fuel properties;

the low-sulfur distillate blend is stable without any separation of blend components according to calculation of P-value;

the low-sulfur distillate blend does not readily form sludge according to calculation of P-value, and the low-sulfur distillate blend has the P-value greater than 1.

14. The low-sulfur distillate blend of claim 13, wherein the low-sulfur distillate blend comprises less than 0.1 wt % sulfur, satisfying IMO sulfur regulations for emission control areas.

15. The low-sulfur distillate blend of claim 13, wherein the low-sulfur distillate blend meets requirements to be classified under DMX distillate fuel grade.

16. The low-sulfur distillate blend of claim 13, wherein the low-sulfur distillate blend meets requirements to be classified under DMB distillate fuel grade.

17. The low-sulfur distillate blend of claim 13, wherein the low-sulfur distillate blend meets requirements to be classified under DMA distillate fuel grade.

18. The low-sulfur distillate blend of claim 13, wherein the low-sulfur distillate blend meets requirements to be classified under DMZ distillate fuel grade.

19. The low-sulfur distillate blend of claim 13, wherein the low-sulfur distillate blend exhibits a viscosity in a range of distillate fuels, between 1.4 and 11 cSt.

20. The low-sulfur distillate blend of claim 13, wherein particulate matter emissions are reduced due to decreased aromatic content.

* * * * *